US007556256B2

(12) United States Patent
Suzuki et al.

(10) Patent No.: US 7,556,256 B2
(45) Date of Patent: Jul. 7, 2009

(54) SHEET FEEDING APPARATUS

(75) Inventors: Yoshiaki Suzuki, Kawasaki (JP); Kazuyuki Morinaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 11/476,593

(22) Filed: Jun. 29, 2006

(65) Prior Publication Data

US 2007/0007711 A1 Jan. 11, 2007

(30) Foreign Application Priority Data

Jul. 5, 2005 (JP) ..... 2005-196129

(51) Int. Cl.
*B65H 3/44* (2006.01)

(52) U.S. Cl. ..... 271/9.13; 271/9.11; 271/9.07

(58) Field of Classification Search ..... 271/9.01, 271/9.07, 9.08, 9.11, 9.13
See application file for complete search history.

(56) References Cited

U.S. PATENT DOCUMENTS 5,391,009 A * 2/1995 Stodder ..... 400/605
5,775,684 A * 7/1998 Jackson et al. ..... 271/9.07
5,890,707 A * 4/1999 Allibert et al. ..... 271/9.09
5,954,326 A * 9/1999 Gaarder et al. ..... 271/9.02
6,022,013 A * 2/2000 Foglino et al. ..... 271/9.08
6,929,414 B2 * 8/2005 Kadomatsu ..... 400/608.2
7,290,763 B2 * 11/2007 Suzuki et al. ..... 271/9.13
2004/0130089 A1 7/2004 Suzuki et al. ..... 271/9.01

* cited by examiner

*Primary Examiner*—Kaitlin S Joerger
(74) *Attorney, Agent, or Firm*—Fitzpatrick, Cella, Harper & Scinto

(57) ABSTRACT

An original stacking plate for supporting and stacking an original is rotatably attached to an ASF base. A fulcrum position of the original stacking plate is provided with a rotational center on the upstream side in the sheet feeding direction from a fulcrum position of a pressing plate while keeping a predetermined distance from a base surface of the ASF base. Therefore, a rotational angle of the original stacking plate in association with the vertical motion of the pressing plate when the original and recording paper have been set is smaller than that of the pressing plate.

10 Claims, 14 Drawing Sheets

SHEET FEEDING APPARATUS

BACKGROUND OF THE INVENTION

1. Field of the Invention

The invention relates to an image reading and recording apparatus integratedly having reading means for reading an image of an original and recording means for recording (printing) the image onto a recording medium. More particularly, the invention relates to a construction of a sheet feeding apparatus which is provided for an image reading and recording apparatus such as a facsimile apparatus or the like and feeds an original as sheets or a recording medium as sheets to the reading means or the recording means.

2. Related Background Art

Hitherto, a facsimile apparatus in which a part of a conveying path of an original and a part of a conveying path of recording paper are constructed in common in order to realize miniaturization and reduction in costs has been proposed. FIG. 16 shows an example of a construction of such an apparatus. In such an example, to further realize miniaturization, a feed roller 304 and a separation roller 303 are constructed in common and the original or recording paper which has been fed and separated passes through the common conveying path. An original stacking plate 309 to stack an original 302 is provided over recording paper 301 in the stacking direction of the recording paper 301 stacked on a pressing plate 308 (recording paper stacking surface). The original stacking plate 309 is fixedly arranged to the pressing plate 308 and can be vertically moved together with the rotation of the pressing plate 308. The recording paper or original conveyed by the feed roller 304 is conveyed by a common conveying roller 310 and reaches a reading unit or a recording unit arranged downstream in the conveying direction of the conveying roller 310.

In the system in the prior art mentioned above, the original stacking plate is fixedly arranged to the pressing plate in almost the parallel state while keeping a predetermined distance from the pressing plate which is repetitively removed from and come into contact with the feed roller. In such a system, an effect can be obtained in the case where the number of recording paper which can be set is large and it is intended to certainly assure a distance from the original stacking plate or in the case where a sufficient space where the original stacking plate can be moved can be assured above the original stacking plate.

However, in the case of decreasing a diameter of the feed roller for the purpose of miniaturizing the sheet feeding mechanism, a defective paper feed has occurred because a contact angle of the original to the feed roller and that of the recording paper to the feed roller are different. In the system in which the sufficient movable space of the original stacking plate cannot be assured above the original stacking plate because of the miniaturization of the whole apparatus, the system in which the original stacking plate is fixed to the pressing plate is disadvantageous.

SUMMARY OF THE INVENTION

It is an object of the invention to realize a sheet feeding apparatus which can realize both of the miniaturization of a sheet feeding mechanism and stabilization of the sheet feeding operation in a system which has two sheet stacking units and in which those two types of sheets are fed by the common sheet feeding mechanism.

Another object of the invention is to provide a sheet feeding apparatus comprising: a base member adapted to stack and hold a bundle of first sheets and a bundle of second sheets almost in parallel; a feed roller adapted to feed the first sheets or the second sheets to a conveying path one by one; a first sheet stacking plate on which the first sheets are stacked and which is rotatably attached to the base member, is away from the feed roller in a standby mode, and is pressed toward the feed roller when the sheets are fed; and a second sheet stacking plate adapted to stack the second sheets, wherein the second sheet stacking plate is arranged over the first sheet stacking plate in its sheet stacking direction so as to have a predetermined gap from the first sheet stacking plate and is rotatably supported to the base member so as to have a rotational fulcrum on the upstream side in the sheet feeding direction from a rotational fulcrum of the first sheet stacking plate.

DETAILED DESCRIPTION OF THE PREFERRED EMBODIMENTS

An embodiment of the invention will be described in detail hereinbelow with reference to the drawings.

As for dimensions, materials, and shapes of component elements, their relative layout, and the like disclosed in the embodiment, the scope of the invention is not limited only to them unless otherwise specified in particular.

Figure 1:
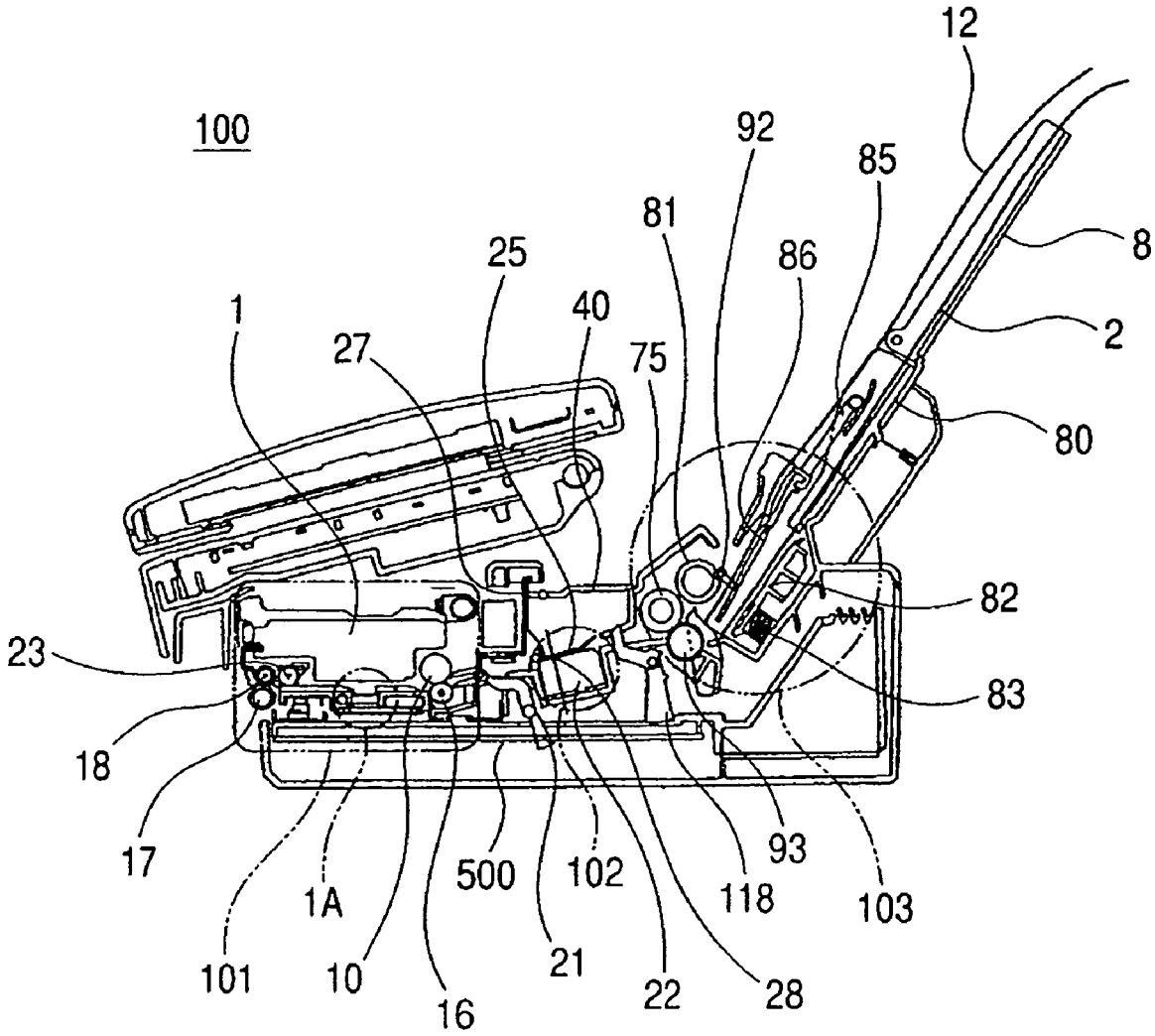
FIG. 1 is a cross sectional view showing a schematic construction of a facsimile apparatus as an example of an image reading and recording apparatus having a sheet feeding apparatus according to an embodiment of the invention.

FIG. 1 is a cross sectional view showing a construction of a facsimile apparatus as an example of an image reading and recording apparatus having a sheet feeding apparatus according to the embodiment of the invention.

Recording paper 2 as sheets and an original 12 as sheets have been set to a facsimile apparatus 100 shown in the diagram. The facsimile apparatus 100 is constructed by: a recording unit 101 having an ink cartridge 1 for recording an image onto the recording paper 2; an image reading unit 102 having an image reader 28 for reading an image of the original 12 as a sheet; and an automatic sheet feeding unit 103 for separating a plurality of sheets of set recording paper or set original 12 one by one and conveying them to a recorder 1A or the image reader 28.

(Automatic Sheet Feeding Unit)

First, the automatic sheet feeding unit 103 will be described.

Figure 2:
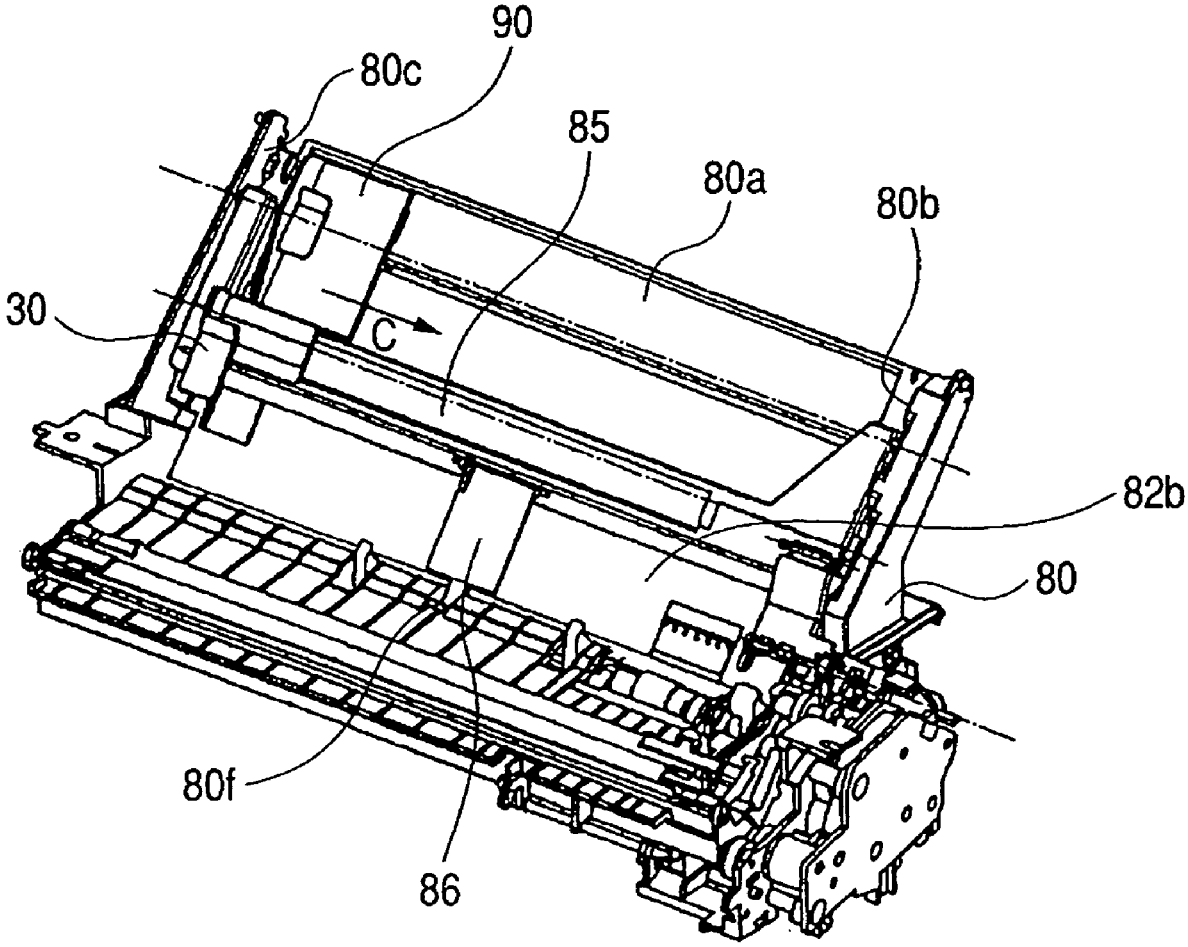
FIG. 2 is a perspective view showing a construction of an automatic sheet feeding unit.
Figure 3:
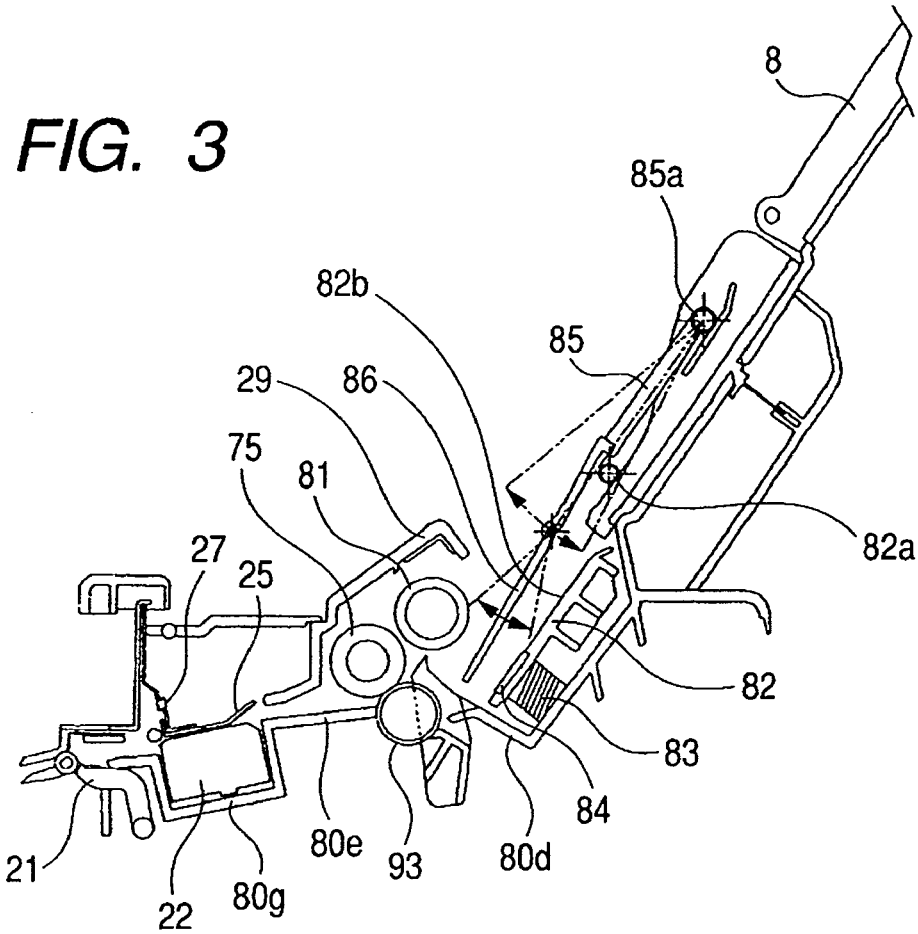
FIG. 3 is a cross sectional view showing the construction of the automatic sheet feeding unit.

FIG. 2 is a perspective view schematically showing the automatic sheet feeding unit 103 at the time when the original 12 and the recording paper 2 are not set. FIG. 3 is a cross sectional view showing the automatic sheet feeding unit 103 at the time when the original 12 and the recording paper 2 are not set.

In FIGS. 1 to 3, an ASF (Automatic Sheet Feeding) base 80 serving as a frame of the automatic sheet feeding unit 103 is constructed by: a base surface 80*a;* a right plate 80*b;* a left plate 80*c;* a front edge reference surface 80*d* on which front edges of the original 12 and the recording paper 2 are abutted when they are set; and a sheet passing surface 80*e*. A first feed roller 81 is rotatably attached to a printer cover 29 through a bearing. A pressing plate 82 is rotatably attached to the right plate 80*b* and the left plate 80*c* of the ASF base 80. The pressing plate 82 is urged to the first feed roller 81 side by a pressing plate spring 83 attached between the back surface of the pressing plate 82 and the base surface 80*a* of the ASF base 80. The pressing plate 82 functions as a pressing member to press a bundle of the recording paper 2 or the original 12 toward the first feed roller 81 in a sheet feeding mode. In a mode other than the sheet feeding mode, the pressing plate 82 is downwardly pressed by a control cam 97*a* (FIGS. 7A to 7C and 8), which will be explained hereinafter, and a pressing plate control lever (not shown). A gap adapted to set the original 12 and the recording paper 2 exists between the pressing plate 82 and the first feed roller 81, thereby allowing the pressing plate 82 to function as a recording paper stacking plate. The pressing plate 82 is urged onto or removed away from the first feed roller 81 by the rotation of the control cam 97*a* (FIGS. 7A to 7C and 8). A separating pad 84 is adhered onto the upper surface of the front edge portion of the pressing plate 82. There is a positional relation in which the separating pad 84 and the first feed roller 81 face in the urging state in the sheet feeding mode.

As shown in FIG. 3, an original stacking plate 85 for supporting and stacking the original 12 is rotatably attached to the ASF base 80. A fulcrum position 85*a* of the original stacking plate 85 is provided with a rotational center on the upstream side in the sheet feeding direction from a fulcrum position 82*a* of the pressing plate 82 while keeping a predetermined distance from the base surface 80*a* of the ASF base 80. Therefore, a rotational angle of the original stacking plate 85 in association with the vertical motion of the pressing plate 82 at the time when the original 12 and the recording paper 2 have been set is smaller than that of the pressing plate 82. Thus, disturbance of the stacking state of the original 12 is decreased even by the vertical motion of the pressing plate 82, resulting in the improvement of the reliability of the sheet feeding operation. When the pressing plate 82 is in pressure contact with the first feed roller 81, if the recording paper 2 or the original 12 set over the recording paper 2 is come into contact with the first feed roller 81 at a similar angle as close as possible, since a difference between the sheet feeding performance hardly occurs, the sheet feeding operation can be stably executed. In the system of the embodiment, since the original stacking plate 85 is set to be rotatable, it can drop to the bottom by the tare weight. Therefore, the state where the original 12 is urged to the first feed roller 81 while being bent does not occur. In other words, since a difference between the contact angle of the original 12 to the first feed roller 81 and that of the recording paper 2 to the first feed roller 81 is very small, the sheet feeding operation is stabilized. There is also such an advantage that the space is smaller than that in the case where the original stacking plate 85 is fixed to the pressing plate 82. The original stacking plate 85 has such a contact surface while keeping the predetermined distance from the base surface 80*a* in the standby mode and is in contact with a part of the pressing plate 82. A center portion of an upper edge portion of the original stacking plate 85 is indented so that the user can easily insert and pull out the recording paper 2 stacked in the lower position of the original stacking plate 85 even if the recording paper 2 is small paper such as card, postcard, or the like.

An original bridge 86 serving as a guide member of the original 12 in the sheet feeding direction is rotatably attached to a lower edge portion of the original stacking plate 85. In the state where the original stacking plate 85 has been attached to the ASF base 80, while a front edge of the original bridge 86 is restricted to a concave portion 80*f* of the ASF base 80 so as to form a predetermined gap between the front edge and a recording paper stacking surface 82*b* of the pressing plate 82, the lower surface of the original 12 is held by the whole original bridge 86. Since the original bridge 86 is located at an offset position in the roller axial direction from the first feed roller 81 and a second feed roller 75, a length of front edge of the original bridge 86 is set so that the original bridge 86 can be shunted from a recording paper conveying path by the rotational motion when the recording paper 2 is fed and conveyed.

First, if only the recording paper 2 has been set, the state of the apparatus changes from the state shown in FIG. 1 to the state where the original 12 has been removed. When the pressing plate 82 is rotated in such a direction as to be urged to the first feed roller 81 by the control cam 97*a* (FIGS. 7A to 7C and 8), which will be explained hereinafter, the top paper in the bundle of the recording paper 2 is come into contact with the first feed roller 81. At this time, Although the original bridge 86 is located in the upper surface portion of the top recording paper 2, since it is located at the position shunted from the first feed roller 81 and a separation roller 93 in the sheet width direction, it is shunted upwardly from the roller surface of the first feed roller 81 lest it obstructs the separation.

Subsequently, when both of the original 12 and the recording paper 2 have been set as shown in FIG. 1, if the pressing plate 82 is rotated by a cam, which will be explained hereinafter, in such a direction as to be urged to the first feed roller 81, the top original 12 is urged to the first feed roller 81 through the recording paper 2. Although the original bridge 86 is sandwiched between the recording paper 2 and the original 12 at this time, since the separating pad 84 is projected from the recording paper stacking surface 82*b* and the original bridge 86 has shunted from the first feed roller 81 in the sheet width direction as shown in FIG. 3, a predetermined urging force acts between the original 12 and the first feed roller 81 without applying an unnecessary deformation to the original 12.

Subsequently, when only the original 12 has been set, if the pressing plate 82 rises upward in such a direction as to be urged to the first feed roller 81, the top paper of the bundle of the original 12 is come into contact with the first feed roller 81. Although the original bridge, 86 is sandwiched between the pressing plate 82 and the original 12 at this time, since the separating pad 84 is projected from the recording paper stacking surface 82*b*, the separating pad 84 and the original bridge 86 are located at the same height position and the original bridge 86 has shunted from the first feed roller 81 in the sheet width direction, the predetermined urging force acts between the original 12 and the first feed roller 81 without applying the surplus deformation to the original. If the separating pad 84 and the recording paper stacking surface 82*b* are set to the same height, it is necessary to deform the original 12 in the width direction by an amount corresponding to the thickness of original bridge 86 in order to urge the original 12 to the first feed roller 81. The urging force is used to deform the original 12. Thus, the proper urging force does not act on the first feed roller 81 and the original is not fed.

A sheet tray 8 to support the recording paper 2 and the original 12 is rotatably fixed to the ASF base 80. When the sheets of the recording paper 2 or the original 12 are not stacked, the sheet tray 8 can be closed so as to cover the sheet stacking surface, thereby preventing the dust from being deposited onto the sheet stacking surface. As shown in FIG. 2, a side guide 90 is attached to the ASF base 80 so as to be slidable in the direction of an arrow C which crosses the conveying direction of the recording paper 2 which is conveyed by the first feed roller 81. An original slider 30 is also attached to the original stacking plate 85 so as to be slidable in the direction of the arrow C. When the recording paper 2 is set, the right edge of the recording paper 2 is abutted on the right plate 80*b* formed on the ASF base 80, the left edge is restricted by the side guide 90, the front edge is supported by the front edge reference surface 80*d*, and the whole recording paper is supported by the sheet tray 8 and the recording paper stacking surface 82*b* of the pressing plate 82 (FIGS. 1 and 2). When the original 12 is set, in a manner similar to the case of the recording paper 2, the right edge of the original 12 is abutted on the right plate 80*b* formed on the ASF base 80, the left edge is restricted by the original slider 30, the front edge is supported by the front edge reference surface 80*d*, and the whole original is supported by the sheet tray 8, the original stacking plate 85, and the original bridge 86 (FIGS. 1 and 3).

Figure 4:
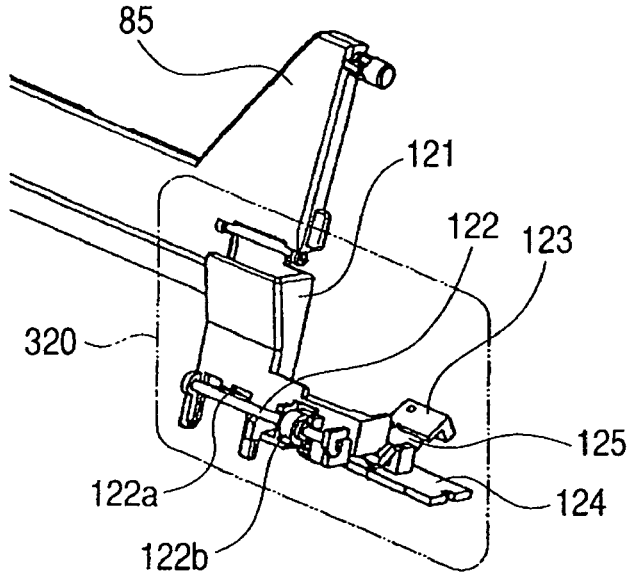
FIG. 4 is a perspective view showing a construction of original sensing means.
Figure 5A:
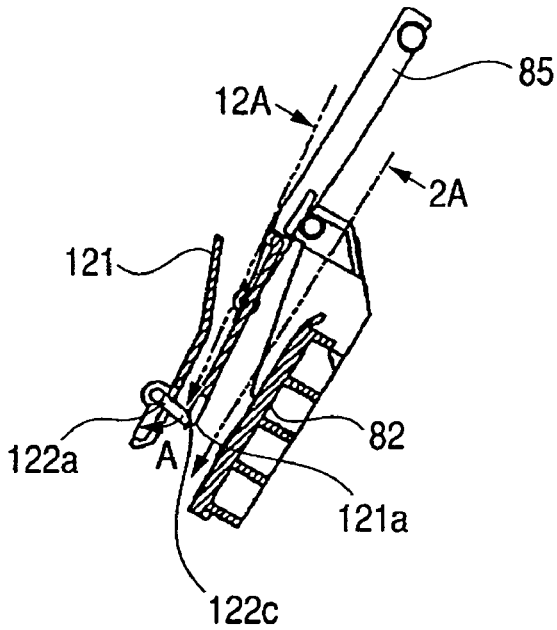
FIGS. 5A and 5B are cross sectional views showing the construction of the original sensing means.
Figure 5B:
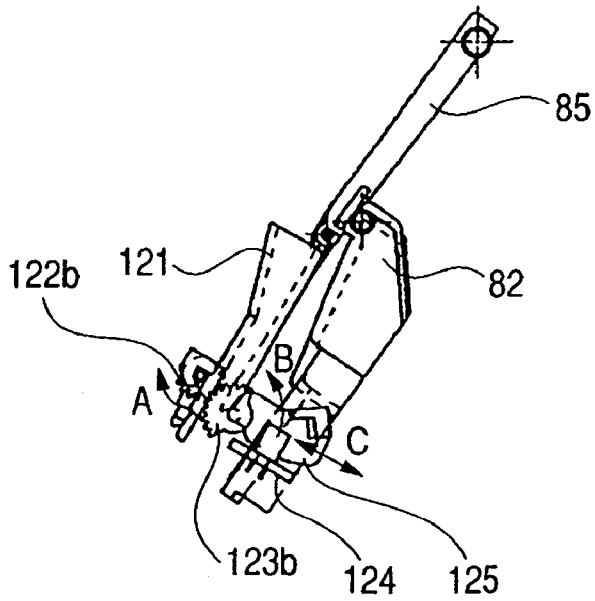

FIGS. 4, 5A, and 5B show a construction of original sensing means 320 for sensing whether or not the original 12 has been set onto the original stacking plate 85.

As shown in FIGS. 4, 5A, and 5B, the original sensing means 320 is rotatably supported to the original stacking plate 85 at the lower right edge position of the original stacking plate 85. The original sensing means 320 is constructed by: an original holder 121; a first original sensing member 122 having a rotational center at an upper position in the stacking direction of the set original 12; a second original sensing member 123; and an original sensing board 124. The original holder 121 is provided so as to support the right edge (reference side) and the lower surface of the original 12 and cover a part of the upper surface. Explanation will be made further in detail. The first original sensing member 122 (sheet contact member) has an axial shape, its one end has a contact surface 122*a* which can be come into contact with the original 12, and the other end has a spur gear portion 122*b*. Likewise, the second original sensing member 123 (interlocking member) has an axial shape, its one end has a light shielding surface 125 for setting a photointerrupter attached onto the original sensing board 124 fixedly arranged out of the range of the sheet stacking surface into a light shielding state or a non-light shielding state, and the other end has a spur gear portion 123*b* adapted to be come into engagement with the spur gear portion 122*b* of the first original sensing member 122. When the original 12 is inserted, the first original sensing member 122 executes such a rotational motion as to escape upward as shown in the direction of an arrow A in FIG. 5A by the contact with the original 12. In the embodiment, since the spur gear portions 122*b* and 123*b* of the original sensing means 320 are in engagement with each other at a reduction ratio of 1:1, the second original sensing member 123 is also rotated in the direction shown by an arrow B in FIG. 5B by the rotation amount of the first original sensing member 122. Thus, the apparatus has such a mechanism that the light shielding surface 125 changes the photointerrupter from the light shielding state to the non-light shielding state. In the embodiment, since the first original sensing member 122 and the second original sensing member 123 are in engagement with each other, a degree of freedom of the layout of the original contact member and an original detection signal generating unit increases and the optimum system can be used with respect to the rotational fulcrum or the like. Since the original 12 is abutted on the original reference surface which is formed by the original holder 121, the first original sensing member 122 held to the original holder 121 can be certainly come into contact with the original 12 and the reliability of the sensing mechanism is improved. In addition, in FIG. 5A, a reference numeral 12A denotes an original sheet inserting inlet and a reference numeral 2A denotes a recording paper inserting inlet.

In the embodiment, since the original sensing means 320 has rotatably been supported to the original stacking plate 85, there is a case where the whole original sensing means 320 fluctuates together with the original stacking plate 85 as a supporting main body due to the setting and insertion of the recording paper 2 or the motion of the pressing plate 82. However, a length of light shielding surface 125 has been adjusted so that the light shielding state can be held even if the second original sensing member 123 was moved in the direction of an arrow C in FIG. 5B for the original sensing board 124 by such a fluctuation. That is, even if the original stacking plate 85 fluctuated, the light shielding surface 125 does not enter the non-light shielding state for the photointerrupter of the original sensing board 124 but functions normally only when the original has been set. A lower surface 121*a* of the original holder 121 and a front edge portion 122*c* of the contact surface 122*a* have been set to such lengths that an interference with the stacked recording paper 2 and the pressing plate 82 does not occur even in the sheet feeding operation of the recording paper 2.

Since the second original sensing member 123 executes the light shielding operation of the photointerrupter on the outer side in the sheet width direction than the stacking range of the sheets in an interlocking relational manner with the first original sensing member 122, the automatic sheet feeding unit can be miniaturized.

Figure 6A:
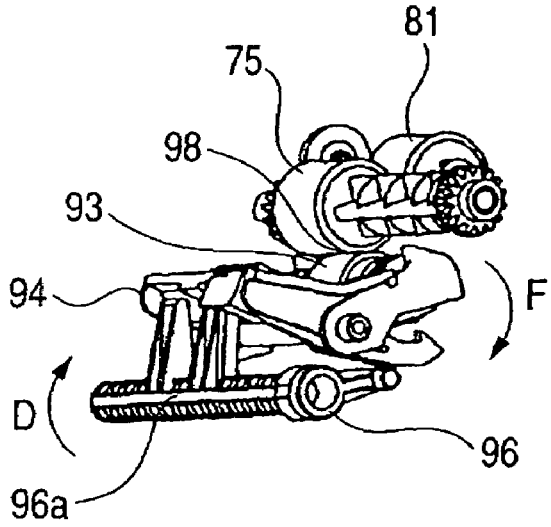
FIGS. 6A, 6B and 6C are perspective views showing a construction of a separating unit of the automatic sheet feeding unit.
Figure 6B:
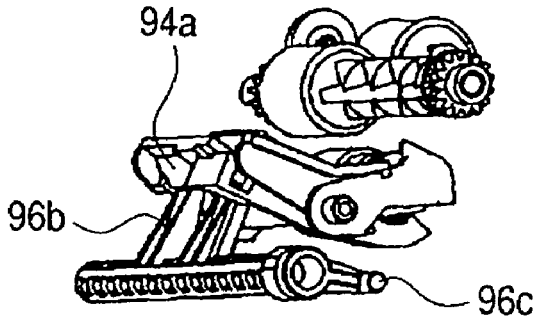
Figure 6C:
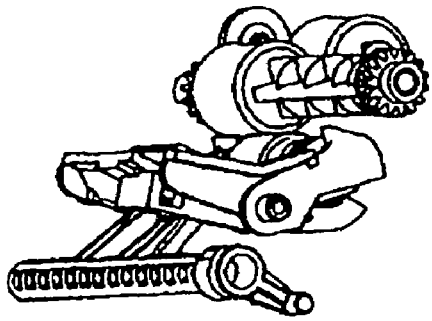

A separating mechanism in the automatic sheet feeding unit 103 will now be described. FIGS. 6A to 6C are perspective views showing the separating mechanism unit of the automatic sheet feeding unit 103. As will be understood from FIGS. 3 and 6A to 6C, the separation roller 93 is arranged so as to nip with the second feed roller 75 on the downstream in the sheet conveying direction from the nip position between the first feed roller 81 and the separating pad 84. The separation roller 93 is axially supported to a separation roller holder 94 through a torque limiter. The separation roller holder 94 is rotatably axially supported to the back surface of the sheet passing surface 80*e* of the ASF base 80. In the sheet feeding mode, the separation roller 93 is urged to the second feed roller 75 by the separation roller holder 94 and a separation roller spring (not shown) hooked to the ASF base 80. In the mode other than the sheet feeding mode, the separation roller 93 is separated from the second feed roller 75 by a release cam lever 96. The release cam lever 96 is constructed by: a shaft portion 96*a;* and a driving cam 96*b* and a driven cam 96*c* formed on both sides of this shaft portion. The release cam lever 96 is rotatable axially supported to the back surface of the sheet passing surface 80*e* of the ASF base 80 and to the left plate 80*c*. The separation roller holder 94 has a driven surface 94*a* corresponding to the driving cam 96*b*. When the release cam lever 96 is rotated in the direction of an arrow D by a predetermined angle, the driving cam 96*b* presses the driven surface 94*a* and the separation roller holder 94 is rotated in the direction of an arrow F, so that the separation roller 93 and the first feed roller 81 are separated (FIGS. 6A and 6B). A driving cam of a control gear 97 (FIG. 8), which will be explained hereinafter, is come into engagement with the release cam lever 96, so that the release cam lever 96 is rotated. The surface of the separation roller 93 is made of a rubber, expanded urethane, or the like so as to have a coefficient of friction similar to that of the feed rollers 75 and 81.

Relations among a torque of the torque limiter, an urging force of the separation roller 93, and the coefficient of friction of each of the rollers 75 and 93 are set so that the mechanism acts as follows. When none of the original 12 and the recording paper 2 is inserted between the second feed roller 75 and the separation roller 93, since a frictional force between the rollers exceeds the torque of the torque limiter, the rotation of the second feed roller 75 is transferred to the separation roller 93, so that the separation roller 93 is rotated. When one sheet of original 12 or recording paper 2 is inserted between the second feed roller 75 and the separation roller 93, since the frictional force (frictional force between the roller and the paper) transferred through the original 12 or the recording paper 2 exceeds the torque of the torque limiter, the separation roller 93 is rotated, so that the sheet is conveyed by the rotation of the second feed roller 75. When two or more sheets of original 12 or recording paper 2 are inserted between the second feed roller 75 and the separation roller 93 in the piled state, since the frictional force (frictional force between the paper and the paper) transferred through the original 12 or the recording paper 2 is smaller than the torque of the torque limiter, the separation roller 93 stops. Only the top paper is conveyed by the rotation of the second feed roller 75. Other sheets of paper are stopped in a nip portion 98 between the second feed roller 75 and the separation roller 93.

Figure 7A:
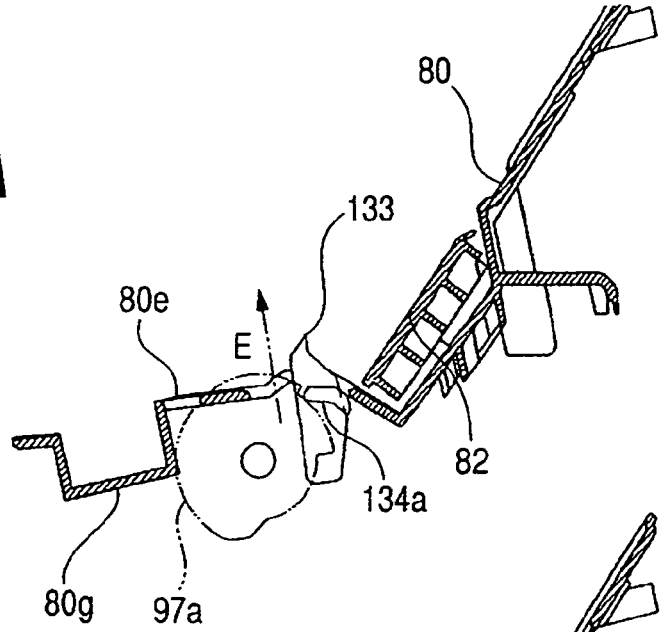
FIGS. 7A, 7B and 7C are cross sectional views showing a state of a return lever of the automatic sheet feeding unit.
Figure 7B:
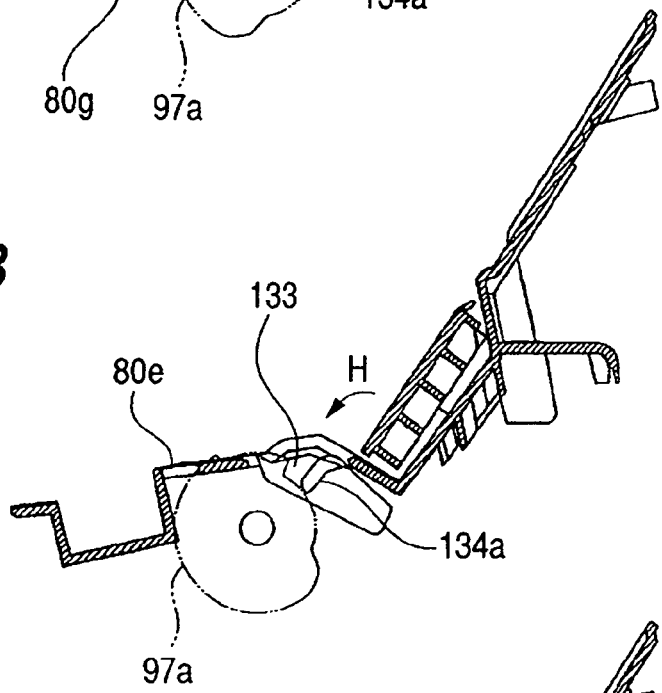
Figure 7C:
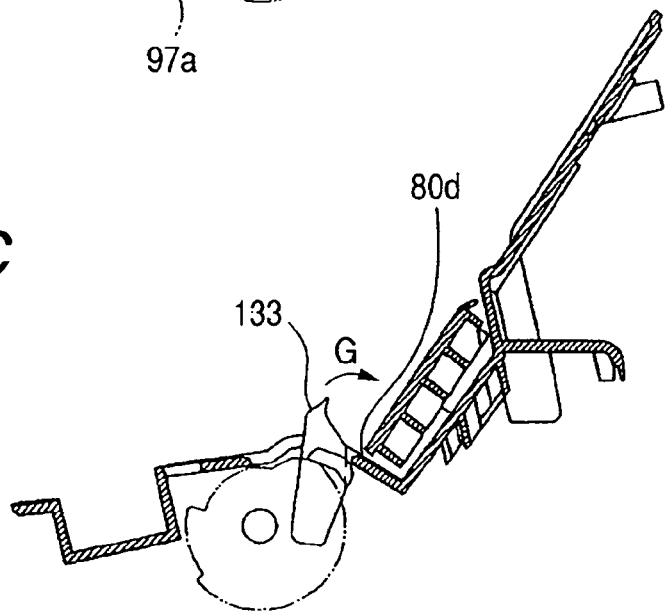

As mentioned above, when a plurality of sheets of original 12 or recording paper 2 are separately conveyed by the separation roller 93 and the second feed roller 75, the second and subsequent sheets of paper are stopped near the nip portion 98 between the separation roller 93 and the second feed roller 75. If the paper remains at this position, when the paper is subsequently fed or the lack of paper is supplemented, the sheet feeding operation cannot be normally executed. Therefore, it is necessary to return the paper existing in the nip portion 98 to the set position. For this purpose, a sheet return mechanism is provided. FIGS. 7A to 7C are schematic cross sectional views showing the sheet returning operation which is executed by the sheet return mechanism. As shown in the diagrams, the sheet return mechanism is constructed by: a return lever 133 which is rotatably axially supported to the back surface of the sheet passing surface 80*e* of the ASF base 80; and the control cam 97*a* for making the return lever 133 operative. The return lever 133 is constructed by a shaft portion and a plurality of claw portions (not shown) and a claw control cam 134 (FIG. 8) is attached to one end of the shaft portion. The claw control cam 134 is urged in the direction of an arrow E by a spring (not shown). The return lever 133 can be set to one of the three kinds of positions shown in FIGS. 7A to 7C by a driven portion 134*a* formed on the claw control cam 134 and the control cam 97*a* which is rotated at the same phase as that of the control gear 97 (FIG. 8), which will be explained hereinafter.

FIG. 7A shows the position of the return lever 133 in the standby mode of the feeding operation. In the standby mode of the feeding operation, a front edge portion of the return lever 133 is inserted into a sheet passing path and allowed to act as a stopper, thereby preventing a front edge portion of the paper from carelessly entering a deep position of the automatic sheet feeding unit 103 when the recording paper 2 and the original 12 are set.

FIG. 7B shows the state where the driven portion 134*a* of the claw control cam 134 is disengaged from the control cam 97*a* of the control gear 97. The return lever 133 is rotated in the direction of an arrow H by an urging force of an urging spring (not shown) and has completely been shunted under the sheet passing surface 80*e* lest the paper is hooked.

FIG. 7C shows the position where the return lever 133 has been slightly rotated in the direction of an arrow G from the state of FIG. 7A and shows the state just after the feeding operation was started and the state when the paper existing in the nip portion 98 has been returned to the set position. Since there is a possibility that the recording paper 2 or the original 12 has newly been stacked during the feed standby mode just after the start of the feeding operation, the operation to return the front edge of the paper to the predetermined front edge reference surface 80*d* is executed. When the return lever 133 has reached this position (position shown in FIG. 7C), the front edge of the preceding recording paper 2 or original 12 is perfectly pushed and returned to the front edge reference surface 80*d*. The front edge of the recording paper 2 existing in the nip portion 98 between the second feed roller 75 and the separation roller 93 is pushed by the operation of the return lever 133 and the paper 2 is returned to the set position. However, since the recording paper 2 has been stacked in the standing state at this time, it is returned so as to be lifted obliquely and upwardly against the tare weight. In this instance, if rigidity of the paper is weak, there is a possibility that the recording paper 2 is not shifted upward but only the front edge is returned and the paper is bent in the middle. But, if the paper has a thickness of about 100 Wm, which is generally used in recording by an inkjet recording apparatus, it is returned to the set position without being bent in the middle. However, since there is a case where thin paper such as a slip or the like having a thickness of about 60 μm in dependence on the original 12, there is a possibility that when it is pushed and returned by the return lever 133; if there is a space in the lower direction, the paper is bent. In the embodiment, therefore, a sheet passing surface which restricts the space in the lower direction is formed by the foregoing original bridge 86, thereby enabling the thin paper to be returned to the set position without being bent.

As shown in FIG. 1, the following component elements are arranged on the downstream side in the sheet conveying direction of the automatic sheet feeding unit 103: a DE (Document Edge) sensor lever 118 to detect the original 12; a PE (Paper-Edge) sensor lever 21 to detect the recording paper 2; a sheet conveying unit for conveying the paper at a predetermined speed in order to execute the recording and reading operations in the recording unit 101 and the image reading unit 102; and a sheet ejection unit to eject the paper in which the recording and reading operations have been executed to the outside of the apparatus. The sheet conveying unit is constructed by: a conveying roller 10 formed by a metal axis and a rubber roller; and a plurality of pinch rollers 16 which have been pressed to the conveying roller 10 and arranged in the paper width direction. The sheet ejection unit is constructed by: an ejection roller 17 formed by integratedly molding elastomer to a shaft made of plastics; a spur A18 urged to the ejection roller 17; and a spur B23 held in the state where there are no members which face it.

A roller 711 (FIG. 8) is rotatably supported to the front edge of the PE sensor lever 21 in the sheet passing direction and can be rotated by frictionally coming into contact with the back surface of the recording paper 2. Even if the recording paper 2 has been conveyed in the direction opposite to the sheet passing direction in order to project the front edge, such an inconvenience that the PE sensor lever 21 bites the recording paper 2 by the frictional force of the PE sensor lever 21 and the recording paper 2 can be eliminated by the roller 711.

Figure 8:
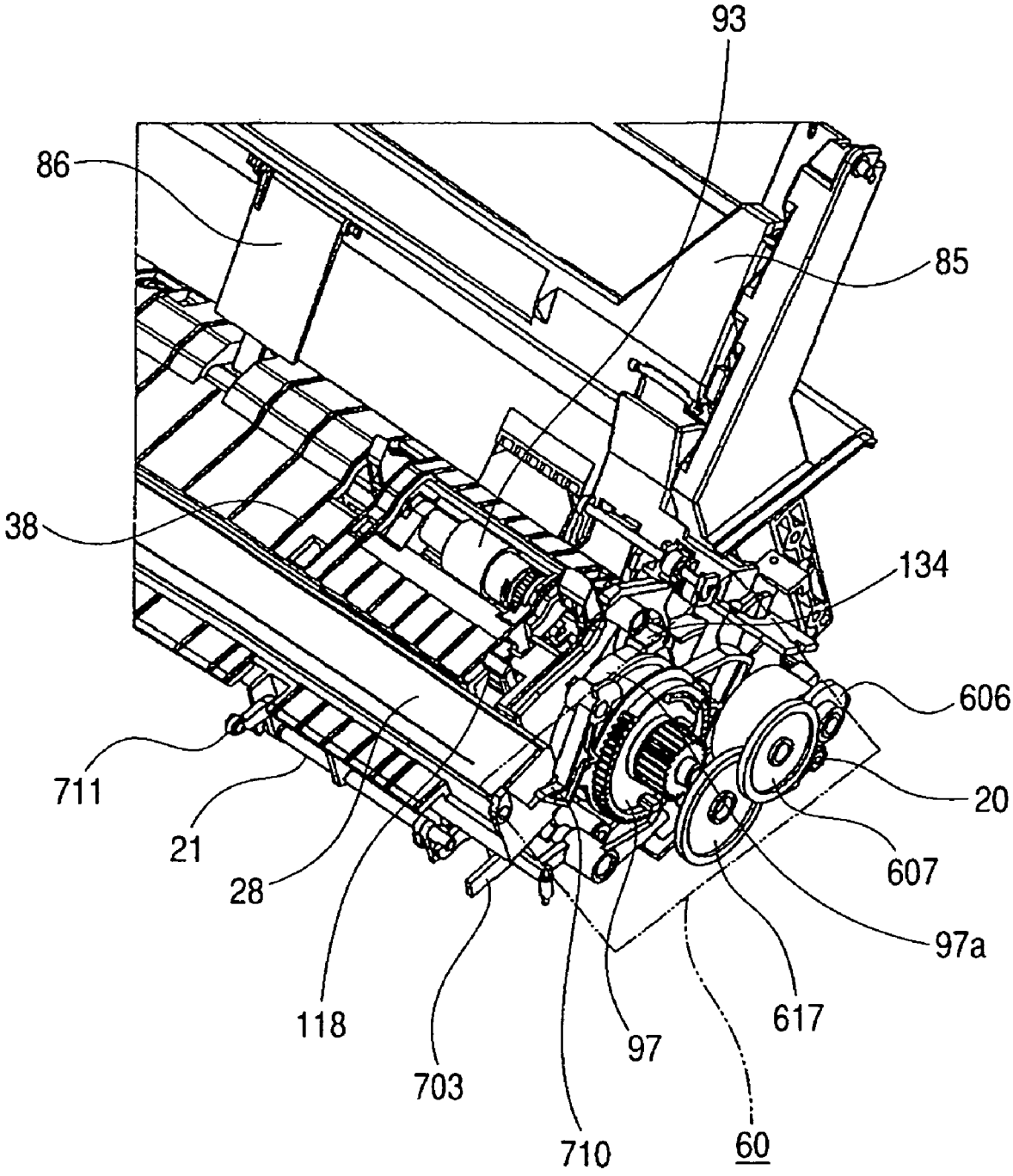
FIG. 8 is a perspective view showing a driving unit of the automatic sheet feeding unit.

As shown in FIG. 8, as a driving mechanism unit of the automatic sheet feeding unit 103, a driving board unit 60 is arranged to the right plate 80*b* of the ASF base 80 and a driving motor 20, a reduction gear A 606, a reduction gear B 607, a sun gear 617, a timer gear (not shown), the control gear 97, and the control cam 97*a* are arranged. In this manner, a driving force from the driving motor 20 is transferred to the control gear 97.

Figure 9:
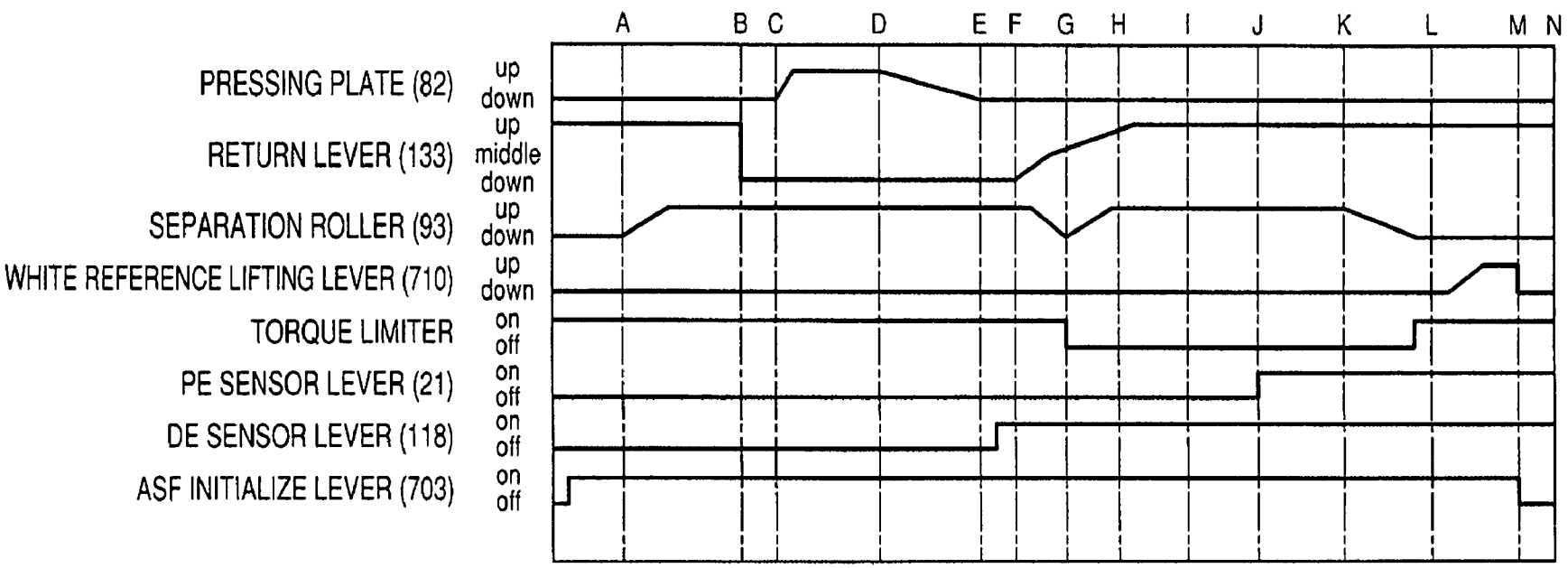
FIG. 9 is a timing chart showing the operation of the automatic sheet feeding unit.

Subsequently, the operation of each component element of the automatic sheet feeding unit 103 will be described with reference to a timing chart. FIG. 9 is a timing chart showing the operation which is executed until the reading or recording is started after the original 12 or the recording paper 2 is fed from the automatic sheet feeding unit 103.

FIG. 9 shows a position of the pressing plate 82, a position of the return lever 133, a position of the separation roller 93, a position of a white reference lifting lever 710, and ON/OFF of each of the torque limiter, the PE sensor lever 21, the DE sensor lever 118, and an initialize lever 703 of the ASF (Automatic Sheet Feeder). According to the sheet feeding operation, since one sheet of the original or the recording paper is fed by one rotation of the control gear 97, an axis of abscissa in FIG. 9 shows a rotational angle (0° to 360°) of one rotation of the control gear 97 and the control cam 97*a,* which will be explained hereinafter.

In FIG. 9, the leftmost state shows the standby mode shown in FIG. 1. A series of operations is started from the standby mode. At this time, the pressing plate 82 is held at the position away from the first feed roller 81, that is, the separation position and the return lever 133 is located at the position shown in FIG. 7A. The separation roller 93 is located at the position where it is shunted from the second feed roller 75 (FIG. 6B), that is, the shunt position. The initialize lever 703 to detect the phase of the first feed roller 81 is OFF (state where it is, disengaged from the photointerrupter).

When the control gear 97 is rotated to an angle A, the separation roller 93 starts the movement from the shunt position to the pressure-contact position and the second feed roller 75 is soon come into pressure contact with the separation roller 93.

When the control gear 97 is rotated to an angle B, the return lever 133 is moved from the sheet passing surface 80*e* to the position where it is shunted downward as shown in FIG. 7B.

When the rotational angle of the control gear 97 is equal to an angle C, the pressing plate 82 starts to move to the first feed roller 81 side.

When the rotational angle of the control gear 97 is equal to an angle D, the top one of the bundle of original 12 stacked on the pressing plate 82 is come into pressure contact with the first feed roller 81. When the top original 12 is come into pressure contact, a few sheets of original from the top are conveyed to the nip portion 98 between the second feed roller 75 and the separation roller 93. In the nip portion 98, only the top one original is separated and conveyed to the downstream in the sheet conveying direction.

At an angle near an angle E of the control gear 97, the front edge of the original reaches the DE sensor lever 118 and turns on the sensor. The separating operation of the pressing plate 82 is finished and the pressing plate 82 is removed from the first feed roller 81.

At an angle near an angle F of the control gear 97, the front edge of the recording paper or the original having a possibility that it was irregularly aligned in the standby mode is started to be returned to the front edge reference surface 80*d*. The separation roller 93 starts to shunt from the second feed roller 75, thereby enabling the returning operation of the return lever 133 to be certainly executed.

At an angle G of the control gear 97, the torque applied to the separation roller 93 is cancelled and the separation roller 93 acts as a roller at an angle subsequent to this angle.

At an angle H of the control gear 97, the foregoing return lever 133 is returning to the standby mode and the separation roller 93 is returned to the pressure-contact state for the second feed roller 75.

At an angle I of the control gear 97, the original reaches the image reader 28.

At an angle near an angle J of the control gear 97, the front edge of the original reaches the PE, sensor lever 21 and turns on the sensor. At an angle rotated by about 30° after that, the front edge of the original reaches the nip portion between the conveying roller 10 and the pinch roller 16.

At an angle near an angle K of the control gear 97, the separation roller 93 starts to be separated again from the second feed roller 75. At a point of time when the separating operation is finished, the torque is started to be applied to the torque limiter. When the separation roller 93 is separated from the second feed roller 75, although the conveyance by the automatic sheet feeding unit 103 is finished, since the separated original is bitten by the conveying roller 10 and the pinch rollers 16, the conveyance is successively executed.

In the case of feeding the original, the control cam 97*a* stops the rotation at the angle near the angle K of the control gear 97 and, thereafter, the conveyance of the original is continued by the conveying roller 10.

In the case of feeding the recording paper, the control cam 97*a* stops the rotation at an angle near an angle L of the control gear 97 and, thereafter, the conveyance of the recording paper is continued by the conveying roller 10. In this instance, the control cam 97*a* is constructed so as to rotate in such a manner that a white reference member 25 (FIG. 1) is shunted from the common conveying path by the action of the white reference lifting lever 710, which will be explained hereinafter.

At an angle M of the control gear 97, the white reference lifting lever 710 is returned, the white reference member 25 is returned to the common conveying path, and the front edges of all of the originals excluding the document which is being fed at present are conveyed to the front edge reference surface 80*d* in the direction opposite to the sheet feeding direction. At the same time, the initialize lever 703 is turned off.

When the rotational angle of the control cam 97*a* is equal to an angle N, the return lever 133 is returned to the position as shown in FIG. 7A, all of the mechanisms enter the same state as the standby mode, and the sheet feeding operation is completed.

(Image-reading Unit)

Figure 10:
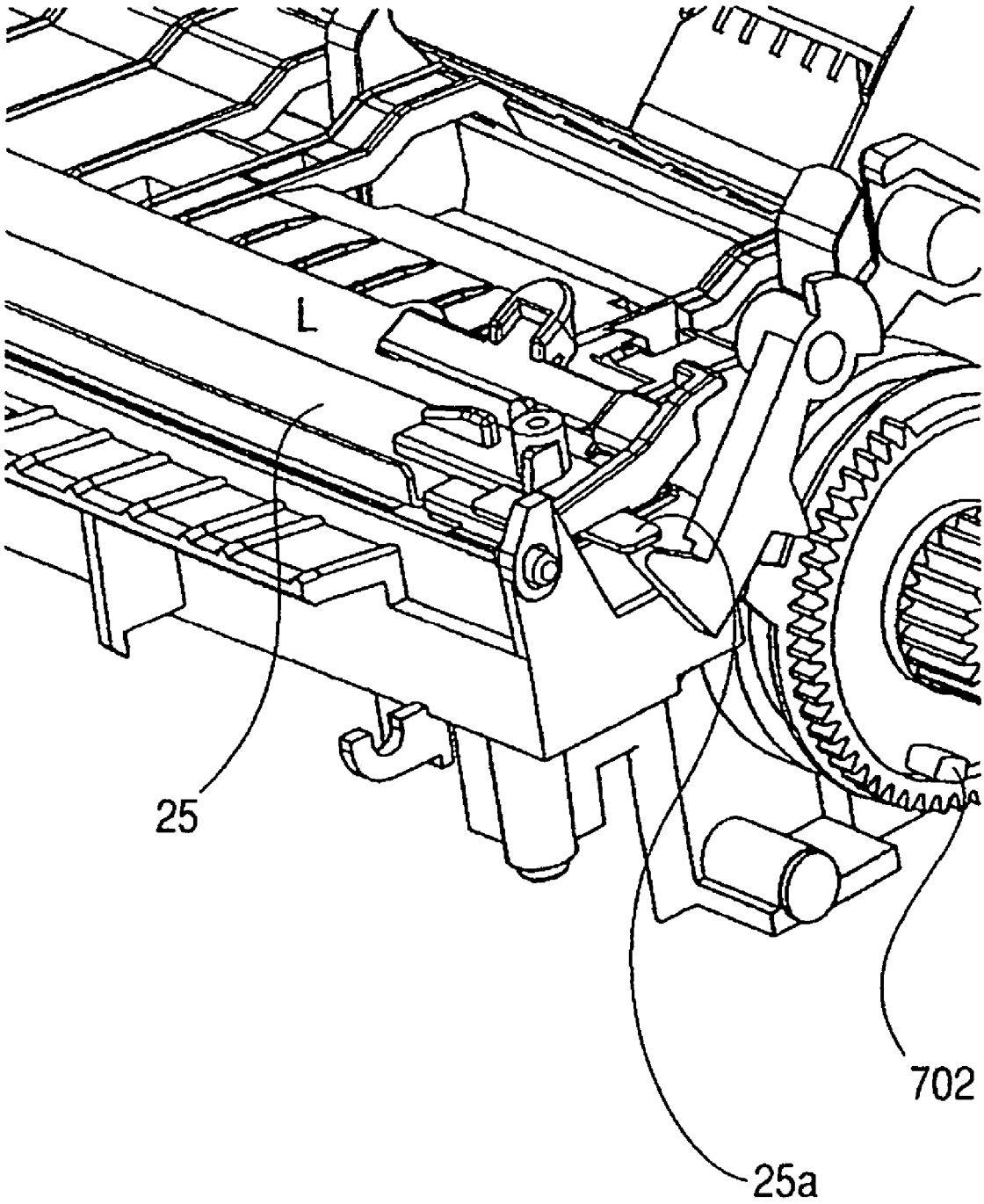
FIG. 10 is a perspective view showing a construction of a white reference member of an image reading unit.

An outline of the image reading unit 102 will now be described with reference to FIGS. 1, 3, and 10. FIG. 10 is a perspective view showing a construction of the white reference member of the image reading unit 102.

The image reading unit 102 is fixedly arranged under the conveying path on the upstream side in the sheet conveying direction for the recording unit 101. While the original 12 fed by the foregoing sheet feeding operation is sandwiched between the second feed roller 75 and the separation roller 93 and is being conveyed, the reading operation is started. After that, the front edge of the original is sandwiched between the conveying roller 10 and the pinch rollers 16 and between the spur A18 and the ejection roller 17, conveyed, and ejected to the outside of the apparatus.

By fixedly arranging the image reader 28 in the recording conveying path as mentioned above, the miniaturization of the whole facsimile apparatus and the reduction in costs can be realized.

The image reader 28 will now be described. The image reader 28 has: a contact image sensor (hereinafter, abbreviated to CS) 22 as image reading means; and the white reference member 25 held in the state where it faces the CS 22. The CS 22 is fixedly held in such a form that it is embedded in the concave portion 80*f* (FIG. 3) of the ASF base 80.

The white reference member 25 is formed by attaching a white sheet to a metal plate. This metal plate has: a flat surface adapted to which the white sheet is attached; and bending portions formed in both end portions in the longitudinal direction. Shafts which are coaxial are held at both ends of the white reference member 25 in the fitting state. By fitting holes formed in the ASF base 80 to the shafts, the white reference member 25 is rotatably supported to the CS 22. In a normal state, the white reference member 25 is urged to the CS 22 side by a white reference urging spring 27 (FIG. 3). In this manner, the white reference member 25 can be set to either a reading position where it is urged by the white reference urging spring 27 and a gap through which one sheet of original can pass is formed or a recording position where the white reference member 25 has been rotated in such a direction as to be separated from the CS 22 against the white reference urging spring 27 (the direction of L in FIG. 10)). In the case where the white sheet of the white reference member 25 or the reading surface of the CS 22 becomes dirty by ink mist or the like of the recorder 1A, the user opens a CS cover 40 (FIG. 1) and sets the white reference member 25 to a cleaning position where it can be more largely rotated than the case of a recording position, so that he can easily clean the dirty portion. Therefore, the apparatus has high maintenance performance. The white reference member 25 has an urging force for the CS 22 by the white reference urging spring 27. Therefore, even if the curled original is conveyed, since it is pressed onto the reading surface of the CS 22 against the force for lifting the white reference member 25, the original does not float from the CS 22 of the image reader 28, resulting in the realization of high picture quality of the read image. The white reference urging spring 27 also has a function of allowing the static electricity caused by the friction with the passing original 12 to escape to the ground because the white reference urging spring 27 is come into contact with another sheet metal member by using electric conductivity of the spring itself.

(Recording Unit)

Figure 11:
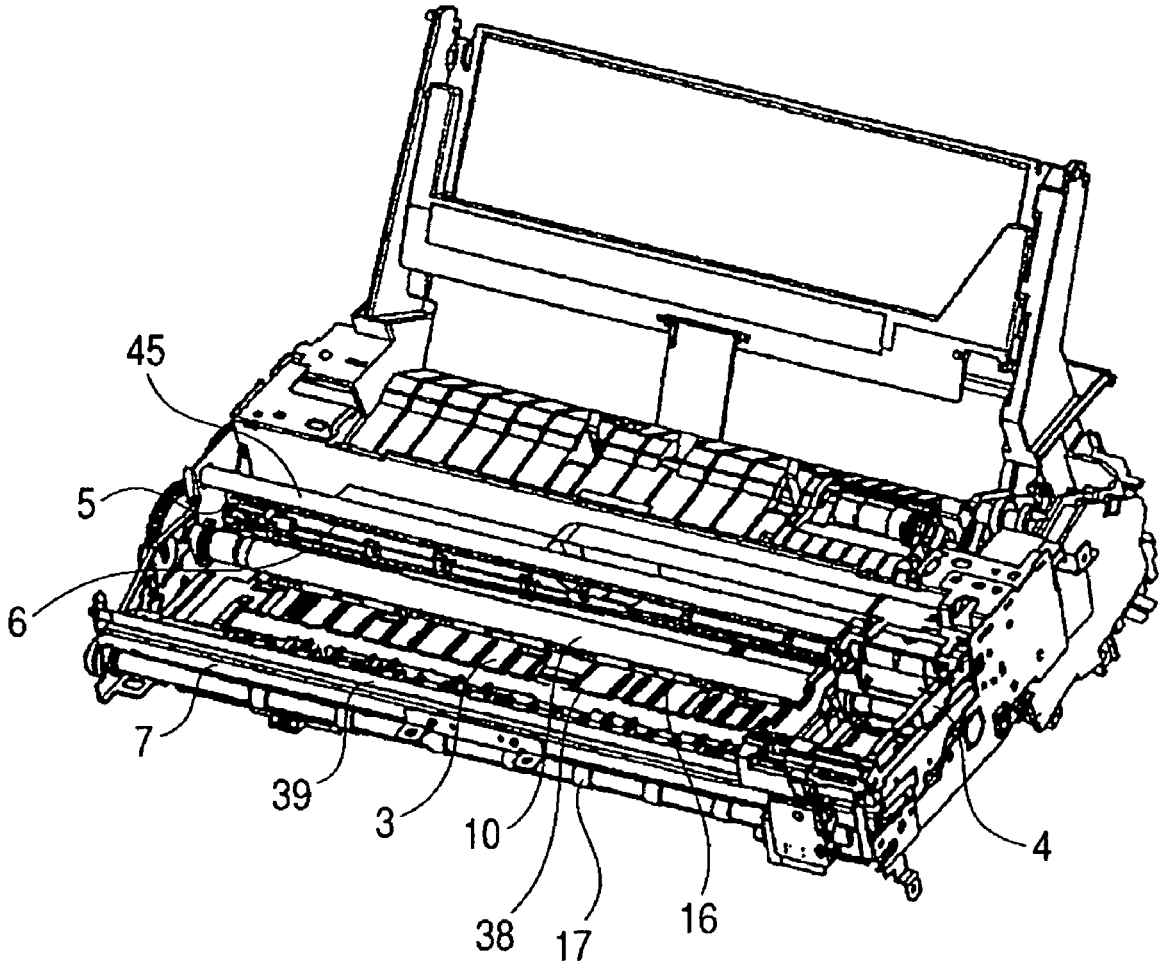
FIG. 11 is a schematic perspective view showing a construction of the whole apparatus including an image recording unit.

The recording unit 101 will now be described with reference to FIGS. 1 and 11. FIG. 11 is a schematic perspective view showing a construction of the whole apparatus including the recording unit 101.

In FIG. 1, the ink cartridge 1 as recording means records an ink image onto the recording paper 2 conveyed by the conveying unit. The recorder 1A is a recorder based on an ink jet recording system for discharging ink droplets from the ink cartridge 1, thereby recording the image.

As shown in FIG. 11, the present apparatus has a carriage 4 on which the ink cartridge 1 is mounted and which scans in the width direction which crosses perpendicularly to the conveying direction of the recording paper 2. A timing belt 6 in an endless belt form suspended between a driving pulley (not shown) and a driven pulley 5 is coupled with the carriage 4. By rotating the driving pulley by a carriage driving motor (not shown), the carriage 4 can be reciprocatively moved along a guide shaft 45 and a guide rail 7. When the carriage 4 is reciprocatively moved as mentioned above, by discharging the ink droplets from the ink cartridge 1 in accordance with the image information, the image is recorded onto the recording paper 2.

As shown in FIG. 11, the carriage 4 is in a standby state at a standby position (capping position) at one end (right end) of the apparatus. When the carriage 4 is located at such a standby position, a recording head (not shown) of the ink cartridge 1 is protected by a rubber member (rubber cap or the like) (not shown) lest it is dried. Also in the original image reading operation, which will be explained hereinafter, the carriage 4 remains at the standby position.

In the ink jet recording system, there is a case where the ink cartridge 1 enters the state where the ink cannot be discharged or the state where it is not suitable for recording due to the mixture of bubbles or dust into the micro inward portion of a discharge port, an increase in viscosity in association with evaporation of an ink solvent, or the like. In such a case, a recording head recovery unit (not shown) executes the head recovery operation to refresh the ink, thereby eliminating factors of the defective discharge.

The foregoing embodiment has a construction obtained by applying the invention to the recording apparatus of the serial type in which the recording head is moved in the main scanning direction (direction which crosses the conveying direction of the recording sheet). However, the invention can be also applied to the recording apparatus of the full-line type in which while continuously conveying the recording sheet, an image is recorded by the recording heads existing along the whole area in the width direction of the recording sheet.

The invention is not limited to such recording systems of the recording head but can be also applied to various recording systems.

As shown in FIG. 11, a platen 3 is provided as a sheet passing surface from the sheet passing surface 80*e* of the ASF base 80 to the ejection roller 17. A plurality of ribs 38 are formed in the paper width direction on the paper supporting surface of the platen 3. When the recording paper is conveyed, the recording paper 2 passes on upper surfaces of those plurality of ribs 38. An auxiliary absorber 39 for borderless recording has been embedded in a center portion of the platen 3 and has been designed in such a manner that in the borderless recording mode, even if a part of color nozzles are projected from an edge portion of the recording paper, the recording is not executed onto the platen 3. However, since the edge portion of a black nozzle on the upstream side in the sheet conveying direction is located at a position shunted from the auxiliary absorber 39, if the borderless recording is performed by the black nozzle, the platen 3 becomes dirty as a result. To avoid such an inconvenience, the embodiment is provided with a recording paper size detecting sensor (not shown) so as to turn on a mechanical switch when the user opens a recording paper slider (side guide 90 in FIG. 2) to the A4-size width corresponding to the maximum size of the recording paper which can be set. If the recording paper whose size is smaller than the A4-size has been set, the black nozzle is not used. By such a structure, the inconvenience such as platen recording and pollution of the original associated with the platen recording can be reduced.

(Driving System)

Figure 12:
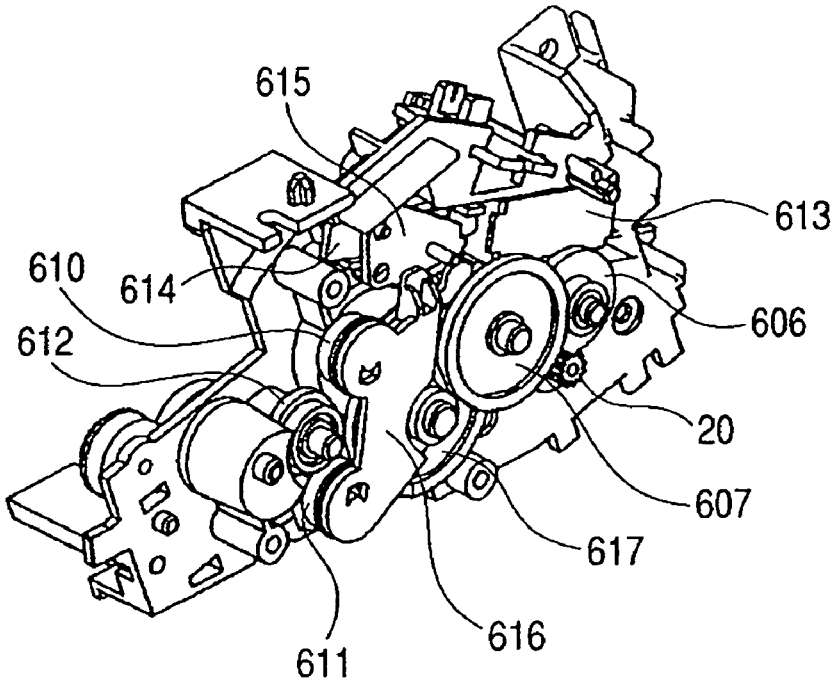
FIG. 12 is a schematic perspective view showing a transfer mechanism from a driving motor.
Figure 13:
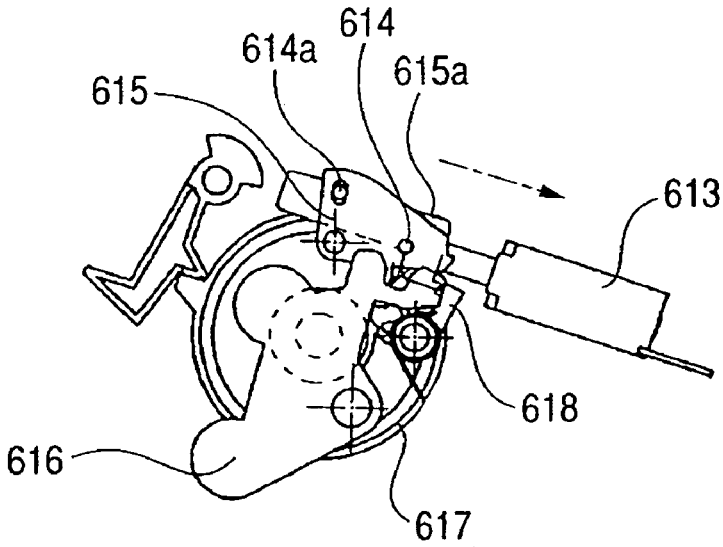
FIG. 13 is a side elevational view showing a construction of a drive switching unit.

Driving means for activating the wiping operation (operation for wiping the ink discharge surface of the recording head by a wiper) of the recovery unit, the sheet feeding operation, and the lifting up/down operation of the cap will now be described in detail with reference to FIGS. 12 and 13.

When the apparatus is in the standby mode, the driving force from the driving motor 20 is connected to the sun gear 617 through the reduction gears A 606 and B 607. In the embodiment, the driving force is connected in such a manner that when the driving motor 20 is forwardly rotated (clockwise in FIG. 12), a planetary output gear 612 is reversely rotated by the action of the sun gear 617 and a planetary gear A 610. When the driving motor 20 is reversely rotated, a planetary gear B 611 is come into engagement with the planetary output gear 612, so that the planetary output gear 612 is forwardly rotated. Since the driving force of the recovery unit has been transferred to the planetary output gear 612, the gear 612 acts so as to lift the cap downward and move the wiper to the front side by the forward rotation of the driving motor 20. The gear 612 acts so as to return the wiper backward and lift the cap upward by the reverse rotation of the driving motor 20.

By forming a neutral state in which the apparatus detects the original 12 and the driving forces of the planetary gears A 610 and B 611 are not transferred to the planetary output gear 612, a state where no driving force is transferred to the recovery unit is formed and only the sheet feeding operation is executed during the feeding and conveyance of the original. A procedure in this case will be described in detail. When the original sensing board 124 (FIG. 4) generates a signal on the basis of the detection by the original sensing means, a control board 500 (FIG. 1) issues an operating command to pull 4 solenoid 613, so that a lever 614 fitted in the solenoid 613 is pulled. A lever axis 614*a* is projected on the lever 614 (FIG. 13). Since the lever 614 is pulled, the lever axis 614*a* rotates a locking member 615 through a fitting hole thereof. A locking axis 615*a* is also projected on the locking member 615. Since the lever 614 is pulled, the locking axis 615*a* is fitted into a concave portion of a pendulum arm 616, so that the pendulum arm 616 cannot be rotated. In this state, both of the planetary gears A 610 and B 611 are not come into engagement with the planetary output gear 612. A latch member 618 adapted to be come into engagement with the locking member 615 in the locking state is provided as means for mechanically holding such a state. The latch member 618 is rotatably axially supported to the driving system and urged counterclockwise in FIG. 13 in the standby state by a spring force. However, since the lever 614 is pulled, the locking member 615 overcomes the urging force and enters a fitting state with the latch member 618. The latch member 618 executes the rotating operation in the direction opposite to the direction of the urging force by coming into contact with the projection of the control cam 97*a*. By this operation, the locking state of the latch member 618 is released. Since the urging force to extend the lever 614 always acts thereon by a spring (not shown), the lever 614 is returned to the standby state instantaneously with the release of the locking state.

(Driving System Cam)

The sun gear 617 is in engagement with the control gear 97 through a timer gear (not shown). The control cam 97*a* is provided for the control gear 97 so as to be rotated at the same phase as that of the control gear 97 (FIG. 8). So long as the driving motor 20 is driven in the forward direction, the driving force from the driving motor 20 is continued to be transferred to the control gear 97 and the control cam 97*a*. When the driving motor 20 is reversely rotated, the foregoing timer mechanism acts on the control gear 97 so as to stop its driving. Therefore, at the time of the reverse rotation of the driving motor such as a case of a cap closure or the like, the control gear 97 is not rotated in the reverse direction.

A projection 702 (FIG. 10) to detect the initialization of the control cam 97*a* is provided for the control gear 97. A pressing plate control cam portion (not shown) to decide the vertical motion of the pressing plate 82 and a separation roller cam groove portion (not shown) to decide the vertical motion of the separation roller 93 are provided for the control cam 97*a*.

First, the projection 702 to detect the initialization of the control cam 97*a* will be explained. When the apparatus is in the standby mode, the initialization is performed by the control gear 97 so that the recording paper or the original can be set. The projection 702 is formed on a part of the circumference of the control gear 97 and a phase for allowing the projection 702 to press the initialize lever 703 (FIG. 8) is provided. The initialize lever 703 has been designed so that it is shunted from the photointerrupter (not shown) only at this phase. By its signal, the control board 500 initializes the phase of the cam portion.

The pressing plate control cam portion to decide the motion of the pressing plate 82 will now be described. The pressing plate control cam portion (not shown) is provided for the control cam 97*a*. By the pressing plate control cam portion and a lever (not shown) for controlling the pressing plate, the operation to lift the pressing plate 82 downwardly against the urging force of the pressing plate spring 83 or the operation to lift the recording paper upward until it is come into contact with the first feed roller 81 by releasing the urging force is executed.

The separation roller cam groove portion to decide the motion of the separation roller 93 will now be described. The separation roller cam groove portion (not shown) is provided for the control cam 97*a*. The control cam 97*a* is rotated in the state where the axial portion projected in the edge portion of the separation roller control lever (not shown) has been fitted into the separation roller cam groove portion, thereby forming the state where the separation roller holder 94 is pressed to or is away from the second feed roller 75.

Figure 14A:
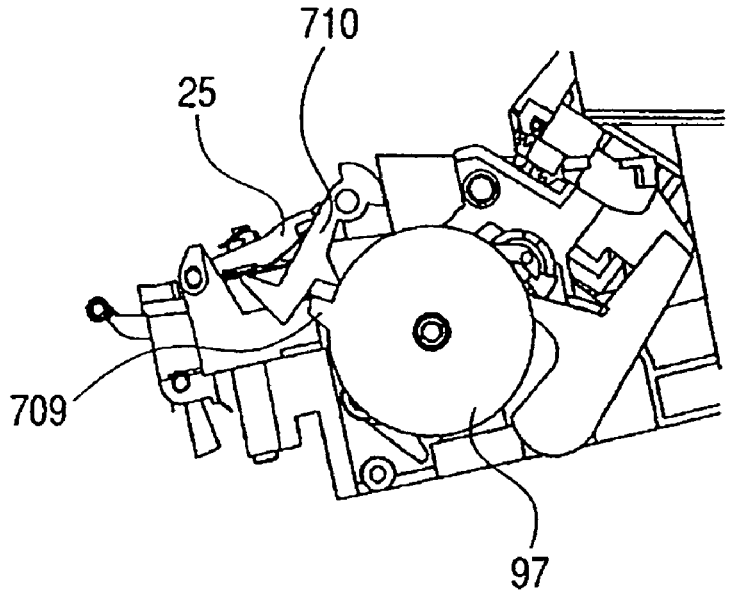
FIGS. 14A and 14B are schematic side elevational views showing a driving mechanism of the white reference member of the image reading unit.
Figure 14B:
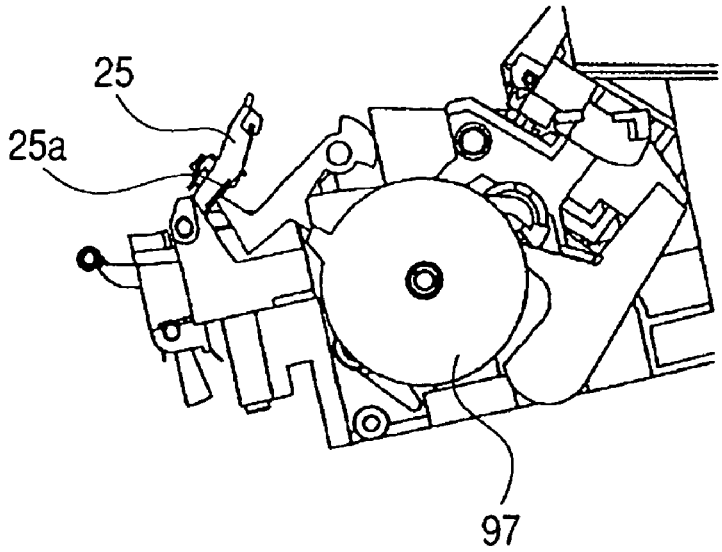

The motion of a white reference member control cam portion will now be described with reference to FIGS. 14A and 14B. In a manner similar to the projection 702 mentioned above, a projection 709 for controlling a white reference member has been projected on the circumference surface of the control gear 97. A phase for allowing the white reference member controlling projection 709 to press the white reference lifting lever 710 is provided. A rotation amount of the driving motor 20 has been set so as to stop at the phase where the control gear 97 has lifted the white reference lifting lever 710 when the recording paper is fed. At this phase, as shown in FIG. 14B, the white reference lifting lever 710 has lifted a contact surface 25*a* provided for the white reference member 25, so that the white reference member 25 has been shunted from the common conveying path. Further, the rotational angle of the white reference member 25 has been set so that the edge portion of the white reference member 25 can be sufficiently shunted from the common conveying path. Therefore, upon recording, a resistance (back tension) which the recording paper 2 which is conveyed by the conveying roller 10 received from the white reference member 25 does not exist. Thus, even in the system in which the image reader 28 has been arranged in the common conveying path, the image reader 28 is not influenced and the recording of the high picture quality can be realized. When the recording operation is finished, the control gear 97 is further rotated by the driving motor 20 and executes the initializing operation by the projection 702 mentioned above.

(Original Reading Operation)

Those operations will now be described along the flow in which the original is fed and conveyed in the above construction. When the original 12 has been stacked onto the original stacking plate 85, the original 12 is detected by the foregoing original sensing means 320 and the apparatus recognizes that the original 12 has been set. When the original reading operation such as copy, transmission, or the like is started, first, the original 12 is fed and only the sheet of original existing at the top position among the original 12 set on the automatic sheet feeding unit 103 is separated, fed, and conveyed to the image reader 28 side. The original 12 separated by the second feed roller 75 and the separation roller 93 passes through the image reader 28 to which the white reference member 25 and the CS (contact image sensor) 22 have been attached. After that, the front edge of the original 12 is conveyed to the nip position sandwiched between the conveying roller 10 and the pinch rollers 16 and the conveying operation is continued.

(Recording Operation)

Those operations will now be described along the flow in which the recording paper is fed and conveyed in the above construction.

When the apparatus starts the recording operation by the copy or reception in the state where the recording paper 2 has been stacked on the automatic sheet feeding unit 103, as mentioned above, first, the driving motor 20 is rotated and only the sheet of recording paper 2 existing at the top position among the recording paper 2 set on the automatic sheet feeding unit 103 is separated and fed. The recording paper 2 is conveyed by a predetermined amount and the front edge of the recording paper 2 is conveyed to the nip position sandwiched between the conveying roller 10 and the pinch rollers 16 and, further, to the recording position. However, the front edge of the recording paper 2 passes through the image reader 28 on the way of the conveyance. Although the image reader 28 is in the state where the white reference member 25 has been covered with a predetermined gap from the reading surface in the standby mode, the white reference member 25 is shunted from the common conveying path by the rotation by the actions of the control gear 97 and the white reference lifting lever 710 as mentioned above. Since the PE sensor lever 21 to detect the front edge of the recording paper 2 has been arranged on the downstream in the sheet conveying direction of the image reader 28, by counting the number of forward rotation pulses and the number of reverse rotation pulses of the conveying roller 10 after the detection of the front edge of the recording paper 2 which passed through the image reader 28, the recording start position of the recording paper can be accurately detected even by the operation of the conveying roller 10, which will be explained hereinafter.

When the recording paper 2 has reached the conveying roller 10, the conveying roller 10 is forwardly rotated, the conveyance of the recording paper 2 is restarted, and at the same time, the carriage driving motor (not shown) is rotated. While the carriage 4 is being moved to the right and left, the recording head of the ink cartridge 1 discharges the ink droplets on the basis of a recording command, thereby recording the image. The recording paper on which the image has been formed by the image recorder 1A is ejected to the position in front of the apparatus by the spurs A18 and B23 and the ejection roller 17. In the case where the recording operation of the second and subsequent sheets of recording paper continues by repeating the similar operation, the recording paper 2 is separated and conveyed and the recording operation is executed.

When the last recording paper is ejected, the carriage 4 is returned to the capping position, and the apparatus enters the standby mode.

(Modifications)

Figure 15:
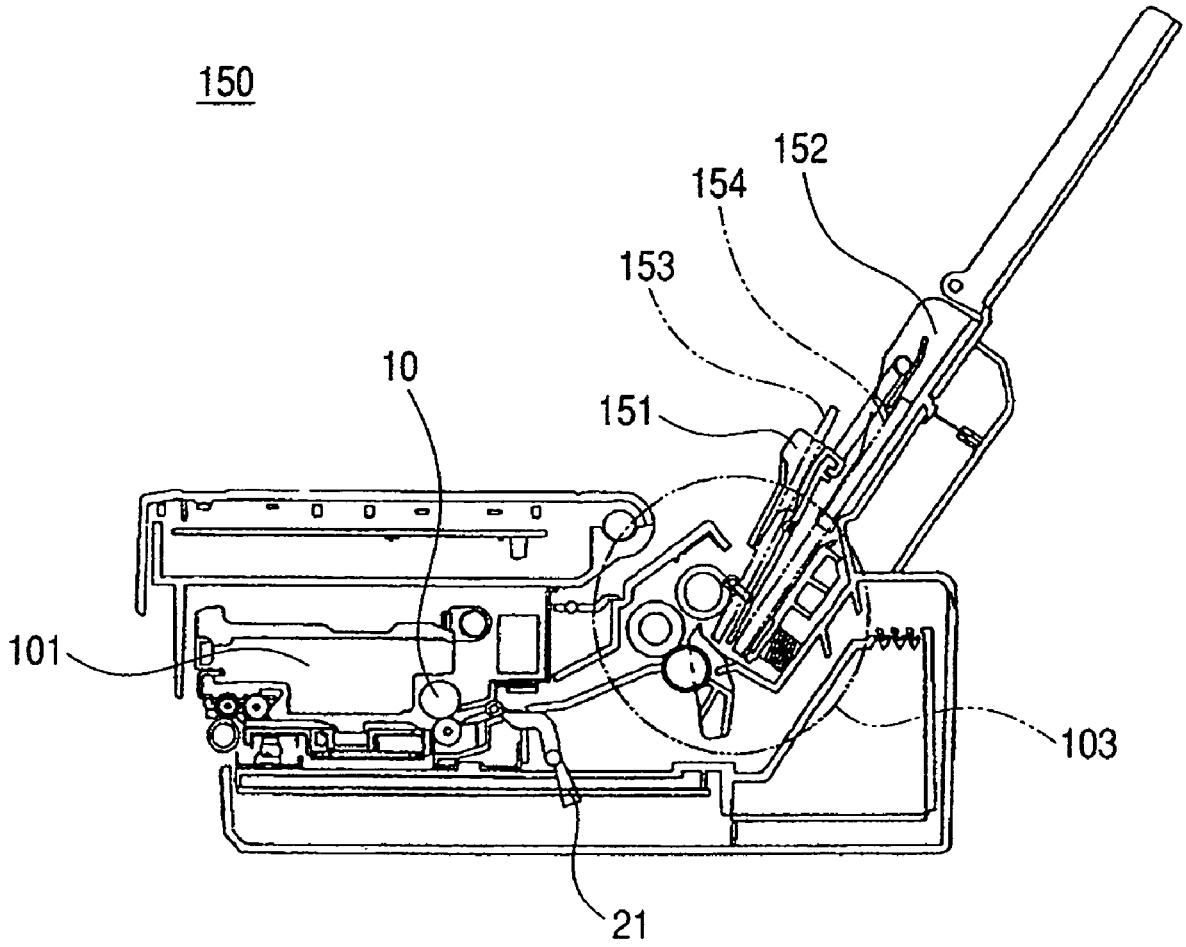
FIG. 15 is an apparatus cross sectional view showing a schematic construction of a recording apparatus as another example having the sheet feeding apparatus according to the invention.
Figure 16:
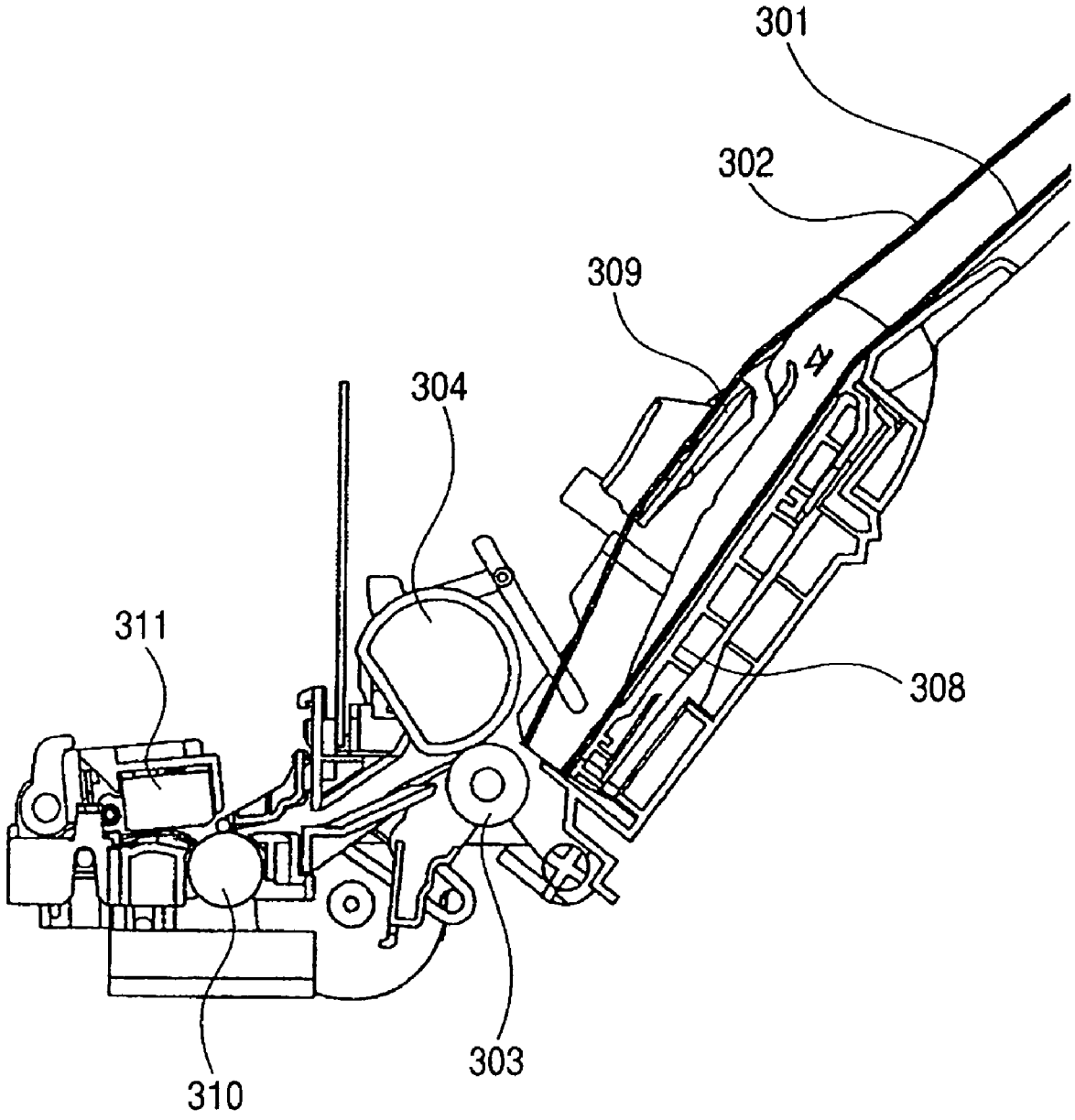
FIG. 16 is an apparatus cross sectional view showing an automatic sheet feeding unit of a conventional image reading and recording apparatus.

As a modification of the foregoing facsimile apparatus 100, FIG. 15 shows a cross sectional view of a recording apparatus having two sheet feeding ports. A recording apparatus 150 shown in the diagram does not have the image reading unit 102 of the foregoing facsimile apparatus 100 and, in place of the original, a bundle of recording paper is set onto the original stacking plate in the automatic sheet feeding unit 103 of the facsimile apparatus 100 mentioned above. That is, as shown in FIG. 15, the recording apparatus 150 is constructed by: the recording unit 101 having the ink cartridge 1 for recording an image onto a first recording paper bundle 153 or a second recording paper bundle 154 as recording media; the automatic sheet feeding unit 103 for separating one by one the first recording paper bundle 153 and the second recording paper bundle 154 which have been set to a first recording paper setting portion 151 and a second recording paper setting portion 152 and conveying each sheet to the image recorder 1A; and an ejection roller and spurs serving as a recording medium ejecting mechanism. Specific constructions of the automatic sheet feeding unit 103, the recording unit 101, and the like are substantially the same as those mentioned above.

Although the first recording paper bundle 153 and the second recording paper bundle 154 can be simultaneously set, in the modification, since the common separating mechanism is used, so long as the first recording paper bundle 153 set in the first recording paper setting portion 151 is not extinguished, the second recording paper bundle 154 is not fed. Means for detecting the presence or absence of the recording paper in the first recording paper setting portion 151 can detect it by using a construction similar to that of the original sensing means 320 used in the facsimile apparatus 100 mentioned above. The detection of the front edge of the first recording paper or the second recording paper is performed by using the common PE sensor lever 21 and the conveyance of the recording paper is performed by using the common conveying roller 10. As sheets of recording paper which are set into the first recording paper setting portion 151 and the second recording paper setting portion 152, respectively, different kinds of media may be used. If photo paper and plain paper or the like are used as a combination, it is not troublesome for the user to exchange the recording paper. Since the common automatic sheet feeding unit and the common conveying mechanism are used although the apparatus has the two recording paper feeding ports, the miniaturization and the cost reduction can be realized.

According to the embodiment of the invention, in the system which has the two sheet stacking units and in which the sheets set therein are fed by the common sheet feeding mechanism, the sheet feeding apparatus which can accomplish both of the miniaturization of the sheet feeding mechanism and the stabilization of the sheet feeding operation can be provided.

This application claims priority from Japanese Patent application No. 2005-196129 filed on Jul. 5, 2005, which is hereby incorporated by reference herein.

What is claimed is:

1. A sheet feeding apparatus comprising:

a first sheet stacking plate, rotatably attached to a base member, for stacking first sheets thereon;

a second sheet stacking plate, rotatably attached to said base member, for stacking second sheets thereon, said second sheet stacking plate being located above said first sheet stacking plate in its sheet stacking direction and being rotated according to rotation of said first sheet stacking plate; and a feed roller being located above said second sheet stacking plate in its sheet stacking direction and adapted to, (1) when the second sheet is stacked on said second sheet stacking plate, perform a sheet feeding operation with contacting the second sheet, and (2) when a second sheet is not stacked on said second sheet stacking plate, perform a sheet feeding operation with contacting the first sheet stacked on said first sheet stacking plate, wherein a rotational fulcrum of said second sheet stacking plate is arranged on the upstream side in the sheet feeding direction of a rotational fulcrum of said first sheet stacking plate, and when said second sheet stacking plate is rotated according to the rotation of said first sheet stacking plate, a rotation angle of said second sheet stacking plate is smaller than a rotation angle of said first sheet stacking plate.

2. An apparatus according to claim 1, further comprising a guide member which is rotatably axially supported to an end portion on the downstream side in the sheet feeding direction of said second sheet stacking plate and is used to guide said second sheet to a position between said first sheet stacking plate and said feed roller.

3. An apparatus according to claim 2, wherein said guide member is restricted so as to be held over said first sheet stacking plate in its sheet stacking direction while keeping a predetermined distance and is arranged at a position offset from a position where said feed roller and said first sheet stacking plate come into contact with each other in a sheet width direction.

4. An apparatus according to claim 1, wherein said first sheets are recording media and said second sheets are originals.

5. An apparatus according to claim 1, wherein both of said first sheets and said second sheets are recording media.

6. An apparatus according to claim 1, further comprising:

a sheet contact member which is contactable with said second sheet and can be moved when said second sheet is stacked onto said second sheet stacking plate;

an interlocking member which is interlocked with said sheet contact member; and a detection signal generating unit adapted to generate a sheet detection signal by the operation of said interlocking member, wherein said detection signal generating unit is arranged out of stacking ranges of said first sheets and said second sheets.

7. An apparatus according to claim 6, wherein said second sheet stacking plate has a holder member adapted to support a sheet width direction reference surface and a lower surface of said second sheet, and said sheet contact member is rotatably held to said holder member.

8. An apparatus according to claim 7, wherein a rotational center of said sheet contact member rotatably held to said holder member is located over said second sheet stacking plate in its sheet stacking direction.

9. An apparatus according to claim 6, wherein said interlocking member has been set so as to normally function for said detection signal generating unit even if said second sheet stacking plate is rotated.

10. An apparatus according to claim 6, wherein said sheet contact member and said interlocking member are interlocked by engagement of gears.

* * * * *